United States Patent [19]

Takase

[11] 4,250,849

[45] Feb. 17, 1981

[54] APPARATUS FOR CONTROLLING THE STARTING FUNCTION OF AN INTERNAL COMBUSTION ENGINE

[75] Inventor: Sadao Takase, Yokohama, Japan

[73] Assignee: Nissan Motor Company, Limited, Yokohama, Japan

[21] Appl. No.: 32,231

[22] Filed: Apr. 23, 1979

[30] Foreign Application Priority Data

Jun. 22, 1978 [JP] Japan ..... 53/74844

[51] Int. Cl.[3] ..... F02N 17/00; F02B 5/00

[52] U.S. Cl. ..... 123/179 G; 123/179 L; 123/491

[58] Field of Search ..... 123/179 B, 179 BG, 179 G, 123/179 L, 32 EG; 290/DIG. 6, 48; 318/136; 318/430

[56] References Cited

U.S. PATENT DOCUMENTS

| | | | |
|---|---|---|---|
| 3,847,130 | 11/1974 | Miyoshi et al. | 123/179 L |
| 3,901,201 | 8/1975 | Mizuguchi et al. | 123/32 EG |
| 3,964,457 | 6/1976 | Coscia | 123/179 L |
| 3,982,519 | 9/1976 | Moon | 123/179 G |
| 4,037,578 | 7/1977 | Dersch et al. | 123/179 G |

FOREIGN PATENT DOCUMENTS

| | | | |
|---|---|---|---|
| 2447198 | 5/1975 | Fed. Rep. of Germany | 123/179 G |
| 1395634 | 5/1975 | United Kingdom | 123/179 L |

*Primary Examiner*—P. S. Lall

*Attorney, Agent, or Firm*—Lowe, King, Price and Becker

[57] ABSTRACT

An apparatus for controlling the starting function of an internal combustion engine comprises at least one monostable multivibrator responsive to turning the ignition key of the engine for producing a pulse signal of a predetermined width, a self-running detecting circuit responsive to the engine speed for producing an output signal indicating that the engine has started. A logic circuit responds to the output pulse of the monostable multivibrator and self-running detecting circuit to produce first and second control signals to control the cranking duration and fuel supply duration.

11 Claims, 3 Drawing Figures

TO STARTER MOTOR SW
TO FUEL SUPPLY MECH
SELF-RUNNING DET 24
MONO
COMP
F-V CONV
PULSE GEN
+Vcc
SW
ON
OFF
D1
D2
Rt
Vt
Vs1
Vs2
Vs3
a
b
c
d
e
f
g
1
2
3
4
5
6
7
8
9
11
12
13
14-1
14-2
14-3
15-1
15-2
15-3
16
17
18
19
20
21
22
23

APPARATUS FOR CONTROLLING THE STARTING FUNCTION OF AN INTERNAL COMBUSTION ENGINE

FIELD OF THE INVENTION

This invention generally relates to an engine start control system. More particularly, the present invention relates to such a system in which excessive fuel supply which may cause the engine to misfire is prevented during cranking.

BACKGROUND OF THE INVENTION

As is well known, when an internal combustion engine is to be started, the engine crankshaft is rotated by the force of an electric motor while an air/fuel mixture is supplied to cylinders of the engine. For instance, in a fuel injection system the basic amount of fuel supplied to the engine is determined in accordance with the amount of intake air and the engine rpm, i.e. the rotational speed of the crankshaft of the engine. This basic amount of fuel is, however, modified by various engine parameters, such as engine temperature and the amount by which the throttle flap is open.

In order to obtain a smooth engine start, the engine is supplied with a rich mixture during cranking. This operation of supplying a rich mixture into the cylinders of the engine takes place not only in a fuel injection system as well as in a carburetor system. If combustion takes place as soon as cranking starts, the air/fuel mixture supplied to each cylinder of the engine is burnt and normal engine operation stars. However, when misfire occurs and cranking takes place continuously, the combustion chamber(s) is wetted by fuel. Accordingly, the spark plug of each cylinder gets wet, whereby firing of the air/fuel mixture is made more difficult. Since the cranking duration may be lengthened as long as desired by turning on the ignition key, it may be impossible to start the engine, especially in fuel injection systems and electronically controlled carburetor systems having a relatively low air/fuel ratio during cranking.

SUMMARY OF THE INVENTION

The present invention has been developed in order to remove the above mentioned disadvantages and drawbacks of internal combustion engines.

It is, therefore, an object of the present invention to provide an apparatus for controlling the starting function of an internal combustion engine in which the cranking duration is limited to a predetermined length of time.

Another object of the present invention is to provide such an apparatus in which misfire of an air/fuel mixture in the combustion chamber does not adversely effect engine starting.

A further object of the present invention is to provide such an apparatus in which fuel supply is terminated when combustion does not take place after a predetermined period of time from the beginning of cranking.

A still further object of the present invention is to provide such an apparatus in which overdischarging the battery is prevented.

BRIEF DESCRIPTION OF THE DRAWINGS

These and other objects and features of the present invention will become readily apparent from the following detailed description of the preferred embodiments taken in conjunction with the accompanying drawings in which.

DETAILED DESCRIPTION OF THE PREFERRED EMBODIMENTS

Figure 1:
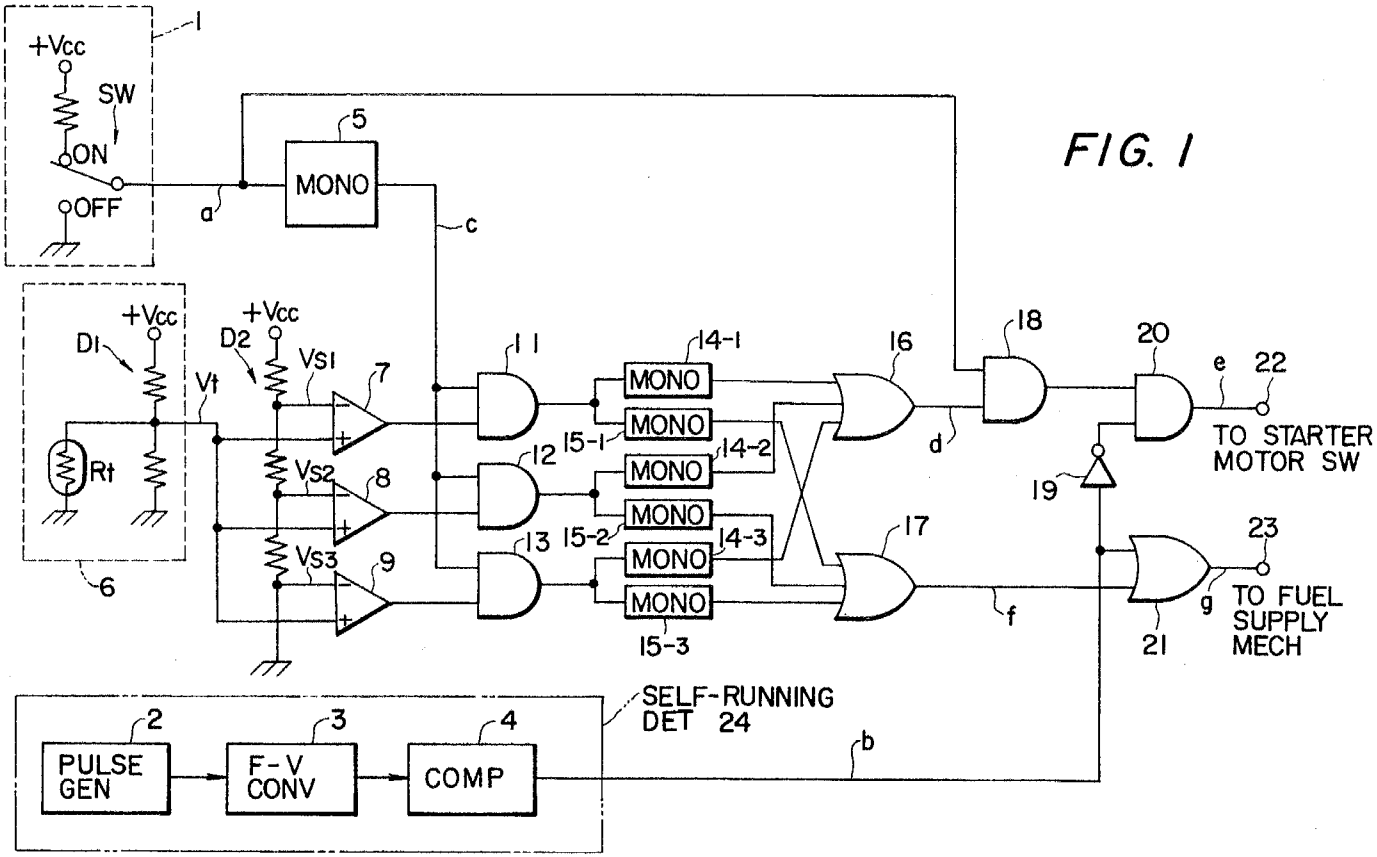
FIG. 1 is a schematic block diagram of a first preferred embodiment of an apparatus for controlling the starting function of an internal combustion engine according to the present invention.

Referring now to FIG. 1, a schematic block diagram of a first preferred embodiment of an apparatus for controlling the starting function of an internal combustion engine is shown as including a switching circuit 1 having a switch SW arranged to be turned on when the engine ignition key is turned on. The switch SW has a movable lever and two stationary contacts respectively connected via a resistor to a positive power supply +Vcc and to ground. Although the switch SW is shown to be a mechanical switch, the switch may be a relay or a switching transistor responsive to turning the ignition key.

When the ignition key of the engine is turned on, the movable lever of the switch SW enters into contact with the first stationary contact (on side) so that a high level signal is emitted from the switching circuit 1. When the ignition key is turned off, the movable contact of the switch SW is in contact with the second contact (off side) to emit a low level signal. The output of the switching circuit 1 is connected to an input of a monostable multivibrator 5 and to a first input of an AND gate 18. The monostable multivibrator 5 is arranged to be triggered by a high level signal to produce a pulse signal, FIG. 2 (c).

Figure 2:
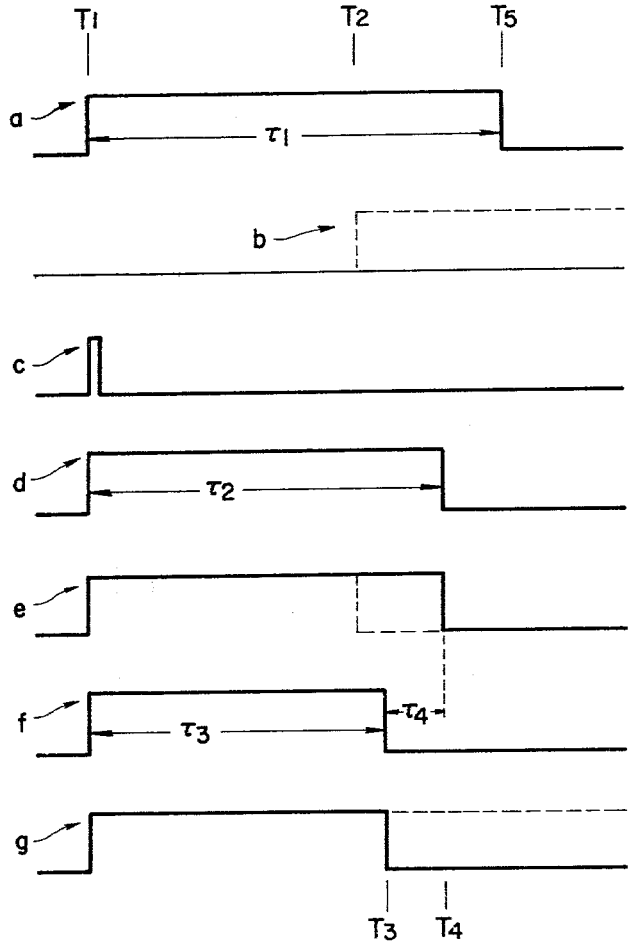
FIG. 2 is a time chart showing waveforms of various signals used in the apparatus shown in FIG. 1.

As shown in FIG. 1, important signals are designated by references from (a) to (g), with the waveforms of these signals shown in FIG. 2. It is assumed that the ignition key of the engine is turned on at time T1 and the turned on state continues for a period of time $\tau_1$. Accordingly, the output signal (a) of the switching circuit 1 assumes a high level from time $T_1$ to time $T_5$ for the same period $\tau_1$. The monostable multivibrator 5 produces relatively short duration pulse signal (c) in response to the leading edge of the pulse signal (a) from the switching circuit 1. The output of the monostable multivibrator 5 is connected to first inputs of three AND gates 11, 12 and 13.

An engine temperature detecting circuit 6 comprises a temperature sensor Rt, such as a thermistor disposed in the water jacket of the engine to be exposed to the engine coolant, and a voltage divider D1. The voltage divider D1 is interposed between a positive power supply +Vcc and ground, while the thermistor Rt is connected in parallel with one of the resistors constituting the voltage divider D1, which resistor is connected to ground. The temperature detecting circuit 6 produces an output signal Vt indicative of the engine coolant temperature at the junction of the two resistors of the voltage divider D1. It will be understood that the voltage Vt of the output signal of the temperature detecting circuit 6 decreases as the engine temperature increases.

The output of the temperature detecting circuit 6 is connected to noninverting inputs (+) of three comparators 7, 8 and 9 each of which has an inverting input (−). A voltage divider D2 is provided to supply the three comparators 7, 8 and 9 with first, second and third reference voltages Vs1, Vs2, and Vs3. The voltage divider D2 includes three resistors connected in series and this voltage divider D2 is interposed between a positive power supply +Vcc and ground. It will be seen that the reference voltages Vs1 to Vs3 have a relationship such as expressed in terms of $Vs1 > Vs2 > Vs3 = 0$. These reference voltages Vs1, Vs2 and Vs3 are respectively supplied to the inverting inputs (−) of the respective comparators 7, 8 and 9. Each of the comparators, therefore, produces a high level output signal when the input voltage Vt indicative of the engine coolant temperature respectively exceeding reference voltages Vs1, Vs2 and Vs3.

With this provision, when the engine temperature is high, i.e. the output voltage of the temperature detecting circuit 6 is low, only the third comparator 9 produces a high level output signal. Assume that the engine temperatures are divided into three ranges, i.e. high temperature range, middle temperature range, and low temperature range. As described in the above, when the engine temperature is in the high range, only the third comparator 9 produces a high level output signal. When the engine temperature is in the middle range, the second and third comparators 8 and 9 produce high level output signals, and when the engine temperature is in the low range, all of the comparators 7, 8 and 9 produce high level output signals. The outputs of these three comparators 7, 8 and 9 are respectively connected to the second inputs of the previously mentioned AND gates 11, 12 and 13. Each of the AND gates 11, 12 and 13 is enabled by the high level signal applied to the second input thereof to transmit the output pulse signal (c) of the monostable multivibrator 5. Therefore, the number of AND gates 11, 12 and 13 enables changes in accordance with the engine temperature.

Each of the outputs of the three AND gates 11, 12 and 13, is connected to inputs of two monostable multivibrators 14-1 and 15-1, 14-2 and 15-2, 14-3 and 15-3. These six monostable multivibrators 14-1, 14-2 and 14-3 and 15-1, 15-2 and 15-3 are therefore arranged to be triggered by the output signals of the three AND gates 11 to 13. Each of the monostable multivibrators 14-1, 14-2 and 14-3 and 15-1, 15-2 and 15-3 produces a pulse signal of a predetermined width. These monostable multivibrators 14-1, 14-2 and 14-3 and 15-1, 15-2 and 15-3 are divided into two groups; namely, the first group includes three monostable multivibrators 14-1, 14-2 and 14-3, while the second group includes other three monostable multivibrators 15-1, 15-2 and 15-3. The pulse widths of the output pulse signals of the first group monostable multivibrators 14-1, 14-2 and 14-3 are arranged to correspond to desirable cranking time for respective engine temperature ranges. In other words, the pulse width of the output pulse signal of the monostable multivibrator 14-1 is longer than that of the monostable multivibrator 14-2 whose output pulse width is longer than that of the monostable multivibrator 14-3. This arrangement is made to determine the cranking duration in accordance with the engine temperature and therefore the cranking duration is made long when the engine temperature is low.

The pulse widths of the output signals of the second monostable multivibrators 15-1, 15-2 and 15-3 are arranged to correspond to durations shorter than the pulse widths of the corresponding monostable multivibrators 14-1, 14-2 and 14-3. For instance, if the pulse width of the output pulse of the monostable multivibrator 14-1 is three seconds, the pulse width of the output pulse of the monostable multivibrator 15-1 is 2.5 seconds. The output pulse signals of the monostable multivibrators 15-1, 15-2 and 15-3 included in the second group are used to determine the duration for which the fuel supply mechanism, such as a series of fuel injection valves, is actuated to supply the engine with fuel.

The outputs of the monostable multivibrators 14-1, 14-2 and 14-3 of the first group are respectively connected to three inputs of a first OR gate 16, while the outputs of the monostable multivibrators 15-1, 15-2 and 15-3 of the second group are respectively connected to three inputs of a second OR gate 17. The output of the first OR gate 16 is connected to a second input of AND gate 18, while the output of the second OR gate 17 is connected to a second input of OR gate 21. The output of the AND gate 18 is connected to a first input of another AND gate 20, having an output connected to a first output terminal 22. The AND gate 20 has a second input connected to an output of a NOT gate 19 (inverter), having an input connected to a self-running detecting circuit 24.

The self-running detecting circuit 24 comprises a pulse generator 2, a frequency-voltage converter 3 and a comparator 4 to produce a high level output signal to indicate that the engine is in the self-running state, i.e the engine has started. The output of the self-running detecting circuit 24 is connected to the input of the NOT gate 19 as described hereinabove and to the first input of the OR gate 21 having an output connected to a second output terminal 23.

The pulse generator 2 included in the self-running detecting circuit 24 produces a pulse train signal in synchronization with the crankshaft rotation. For instance, the ignition pulse signal developed in the ignition coil may be picked up to trigger a suitable pulse generator. The output of the pulse generator 2 is connected to an input of the frequency to voltage converter 3 in which the frequency of the pulse signal is converted into an analogue signal the voltage of which is in proportion to the frequency. The output of the frequency-voltage converter 3 is connected to an input of a comparator 4 which produces a high level output signal when the input voltage exceeds a predetermined reference voltage which is applied to the comparator via a suitable voltage divider (not shown). With this structure, the self-running detecting circuit 24 produces a high level output signal indicative of the self-running state of the engine, by detecting the difference in rotational speed of the crankshaft of the engine between cranking and self-running.

The first and second output terminals 22 and 23 of the apparatus shown in FIG. 1 are respectively connected to a switching circuit and a fuel supply mechanism. The switching circuit connected to the first output 22 is arranged to close to supply electric power from a power supply such as a battery to the starter motor of the engine when the output signal (e) of the AND gate 20 assumes a high level. Although the second output 23 may be directly connected to the fuel supply mechanism to control the fuel supply function thereof in accordance with the output signal (g) of the OR gate 21, the second output terminal 23 may be connected to a suitable control signal generator which derives a control signal for controlling the fuel supply mechanism.

The operation of the apparatus for controlling the starting function of an internal combustion engine is now described in detail by referring to FIG. 2.

It is assumed that the driver of the vehicle turns on the ignition key so that the switch SW included in the switching circuit 1 turns on at time $T_1$; this turned on state continues until time $T_5$. The duration between time $T_1$ and time $T_5$ is indicated by a reference $\tau_1$. A high level signal (a) transmitted via the switch SW is applied to the AND gate 18 and to the monostable multi-vibrator 5 to trigger the same. The monostable multi-vibrator 5 produces a pulse signal (c) which is applied to the three AND gates 11, 12 and 13. At this time it is assumed that the engine temperature is in the high range and all of the comparators 7, 8 and 9 produce high level signals so that the three AND gates 11, 12 and 13 are all enabled to transmit the pulse signal (c) to the first and second groups of the monostable multivibrators 14-1, 14-2 and 14-3 and 15-1, 15-2 and 15-3. The monostable multivibrators 14-1, 14-2 and 14-3 of the first group produce pulse signals of different widths, such that the pulse width of the monostable multivibrator 14-1 is the longest. Therefore, the first OR gate 16 transmits the longest pulse signal (d) to the AND gate 18. Meanwhile, the monostable multivibrators 15-1, 15-2 and 15-3 of the second group produce pulse signals of different widths, where the pulse width of the monostable multivibrator 15-1 is the longest. The second OR gate 17, therefore, transmits the longest pulse signal (f) to the OR gate 21. The pulse widths of the pulse signals (d) and (f) are indicated by references $\tau_2$ and $\tau_3$. Since the AND gate 18 is responsive to the pulse signals (a) and (d), the AND gate 18 transmits the pulse signal (d) to the first input of the AND gate 20.

At the beginning of a cranking period the self-running state of the engine has not yet been established; therefore, the output signal of the self-running detecting circuit 24 is of a low level. This low level signal is inverted by inverter 19 into a high level signal that is applied to the second input of the AND gate 20. Consequently, the AND gate 20 is enabled to transmit the pulse signal (d) to the starter motor switch. The starter motor is thus energized to initiate cranking. As shown in FIG. 2 the pulse width of the output pulse (e) of the AND gate 20 equals the width of the pulse signal (d), and therefore, cranking continues for the period of time corresponding to the width $\tau_2$ of the pulse (d). The output pulse (f) of the second OR gate 17 is supplied via the OR gate 21 to the fuel supply mechanism so that fuel or air/fuel mixture is supplied to the combustion chambers of the engine. The width of the pulse signal (g) from the OR gate 21 corresponds to the width $\tau_3$ of the pulse signal (f).

In the above, the operation is described under an assumption that self-running of the engine is not established during the period $\tau_3$ for which fuel is supplied to the engine. In this case, the fuel supply finishes at time $T_3$ and cranking ends at time $T_4$. The unburnt gas, i.e. air/fuel mixture, in the combustion chambers, is exhausted via the cranking between times $T_3$ and $T_4$. Since the unburnt gas is emitted from the engine cylinders for a period of time $\tau_4$, the inner surfaces of the cylinders as well as the spark plugs do not get wet. With this operation desirable condition of combustion chambers is established at the end of the starting operation and this desirable condition of combustion chambers is advantageous for the next starting operation. The vehicle driver again manipulates the ignition key to start the engine.

In the next starting operation, it is assumed that the engine started at time $T_2$. Since self-running state of the engine is established at time $T_2$, the self-running detecting circuit 24 produces a high level output signal (b) as shown by a broken line. The high level signal is applied via the OR gate 23 to the fuel supply mechanism to continuously supply the engine with fuel. (See a disabled line at signal (g) in FIG. 2). In other words, the output signal (g) of the OR gate is maintained at high level irrespectively of the pulse width $\tau_3$ of the pulse signal (f).

The high level signal from the self-running detecting circuit 24 is inverted into a low level signal by the NOT gate 19 and thus the AND gate 20 is disabled at time $T_2$. Consequently, the pulse width of the pulse signal (e) is shortened and therefore, cranking finishes at time $T_2$. This means that the cranking operation ends immediately after the engine has started. (See a disabled line at signal (e) in FIG. 2)

If the vehicle driver turns off the ignition key during the period $\tau_2$, the cranking operation stops irrespective of the pulse width $\tau_2$ since the AND gate 18 is disabled by a low level signal (a) from the switching circuit 1. Although in the above described operation it is assumed that the engine temperature is in the high range, the apparatus operates in the same manner in other engine temperature ranges, where the durations of cranking and fuel supply vary in accordance with the engine temperature.

The following table includes a summary of the operation of the apparatus.

| CRANKING | FUEL SUPPLY |
|---|---|
| 1. Cranking continues as long as the ignition key is turned on within a predetermined duration defined by the mono multivibrator (14-1, 14-2 and 14-3) pulse width.<br>2. Cranking is finished if engine is started. | 1. Fuel is supplied to engine for a period corresponding to width of mono multivibrator (15-1, 15-2 and 15-3) output pulse.<br>2. Fuel is continuously supplied after engine has started. |

In the above described first embodiment, the comparator 4 included in the self-running detecting circuit 24 produces a high level signal when the rotational speed of the engine is above a predetermined value. The predetermined value is set by adjusting the threshold voltage of the comparator 4 a little lower than a normal idling rotational speed such as 700 rpm. However, the rotational speed of an internal combustion engine under idling is not uniform in all various kinds of engines. Furthermore, the engine speed under idling can be manually changed by adjusting the amount of fuel supplied to the engine during a nonaccelerating state. For the above reason, the threshold voltage of the comparator 4 is adjusted so that the threshold voltage corresponds to an engine rotational speed a little lower than the set idling speed of the engine. However, if a variation in the rotational speed between cranking and self-running is detected, such adjustment is not required.

Figure 3:
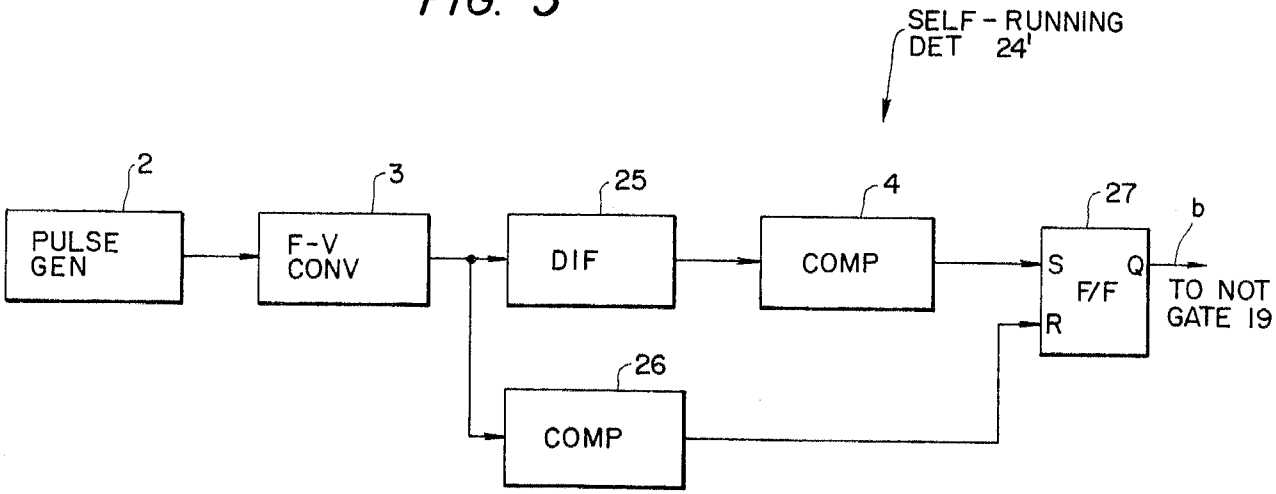
FIG. 3 is a schematic block diagram of a second preferred embodiment of the apparatus for controlling the starting function of an internal combustion engine according to the present invention.

Hence, a second embodiment of the apparatus for controlling the starting function of an internal combustion engine according to the present invention is described in conjunction with FIG. 3. The embodiment of FIG. 3 includes a self-running detecting circuit 24' which may be used in place of the self-running detecting circuit 24 shown in FIG. 1. The circuit 24' includes a pulse generator 2, a frequency-voltage converter 3, a differentiator 25, first and second comparators 4 and 26 and a flip-flop 27. The same circuits as in the first embodiment shown in FIG. 1 are designated by the same reference numerals.

The frequency to voltage converter 3 produces an analogue signal indicative of the engine speed in the same manner as in the first embodiment and this analogue signal is applied to an input of the differentiator 25 and to an input of the second comparator 26. The differentiator 25 produces an output pulse signal the magnitude of which is in proportion to the time rate of charge of the voltage variation rate of the analogue signal derived from the frequency to voltage converter 3. The output of the differentiator 25 is connected to an input of the first comparator 4 so that the first comparator 4 produces a high level output signal when the voltage of the differentiated signal is above a predetermined value corresponding to the reference voltage of the first comparator 4. The output of the first comparator 4 is connected to a set terminal S of a flip-flop 27, having a output Q connected to the input of the NOT gate 19 shown in FIG. 1. The flip-flop 27 has a reset terminal R connected to the output of the second comparator 26. The second comparator 26 is arranged to produce a high level output signal when the voltage of the analogue signal from the frequency to voltage converter 3 is below a predetermined value. The threshold voltage of the second comparator 26 is set to correspond to a predetermined rotational speed of the engine, such as 400 rpm.

The self-running detecting circuit 24' shown in FIG. 3 operates as follows. When an engine start operation is initiated, the output voltage of the frequency to voltage converter 3 suddenly rises to a voltage corresponding to the normal cranking speed such as 300 rpm. While cranking continues, the second comparator 26 produces a high level output signal so that the flip-flop 27 is maintained at a reset state and thus the output signal (b) of the flip-flop 27 assumes a low level. When the engine starts, the rotational speed of the crankshaft of the engine suddenly increases to an idling speed such as 600 to 800 rpm. Accordingly, the output voltage magnitude of the frequency to voltage converter 3 rapidly increases and this increase in voltage is detected by the differentiator 25. The output pulse of the differentiator 25 is shaped by the first comparator 4 so that a high level pulse signal is applied to the set terminal S of the flip-flop 27 to set the same.

Meanwhile, the output signal of the second comparator 26 assumes a low level since the rotational speed of the crankshaft is above the predetermined value defined by the threshold voltage of the second comparator 26. The flip-flop 27 is, therefore, set to produce a high level output signal (b) at the output Q. This output signal (b) is used in the same manner as in the first embodiment.

The set state of the flip-flop 27 is maintained until the flip-flop 27 is reset by the high level output signal of the second comparator 26. When the engine stops, the rotational speed thereof falls to zero and thus the second comparator 26 produces a high level output signal by which the flip-flop 27 is reset. The threshold voltage of the second comparator 26 is set so that it corresponds to a predetermined engine speed such as 400 rpm. Since the threshold voltage of the second comparator 26 is set at such a value, the second comparator 26 produces a high level signal during cranking and this high level output signal resets the flip-flop 27. The flip-flop 27 is designed to be reset when a high level signal is applied to the reset terminal R irrespective of the state of the set signal applied to the set terminal S thereof. Therefore, although during the initial cranking stage the rotational speed of the crankshaft increases rapidly from zero and the first comparator 4 may produce a high level output signal upon detection of the flat variation in the voltage magnitude of the output of frequency to voltage converter 3, the high level output signal of the first comparator 4 does not influence the flip-flop 27 while the reset terminal R receives the high level signal from the second comparator 26.

In the above described embodiment, the durations for which cranking continues and fuel is supplied are respectively changed in accordance with the engine temperature. However, this arrangement is not essential. In other words, the duration of cranking and the duration of fuel supply may be of predetermined periods.

From the foregoing, it will be understood that the maximum duration of cranking is predetermined so that overdischarge of the battery is prevented. Furthermore, since the unburnt gas induced in the combination chambers is exhausted from the combustion chambers when normal combustion does not take place, difficulty in the next starting operation is eliminated. It will be appreciated that engine starting is much easier when the apparatus according to the present invention is utilized, especially in cold seasons.

While there has been described and illustrated one specific embodiment of the invention, it will be clear that variations in the details of the embodiments specifically illustrated and described may be made without departing from the true spirit and scope of the invention as defined in the appended claims.

What is claimed is:

1. An apparatus for controlling a starting motor for an internal combustion engine, comprising:

(a) first means responsive to a command signal for initiating operation of the starting motor of said engine for producing a first signal;

(b) second means responsive to said first signal for producing a second signal for a predetermined period of time;

(c) third means for producing a third signal indicating that said engine is in a self-running state; and (d) fourth means responsive to said second and third signals for terminating operation of the starting motor of said engine upon absence of said second signal or when said engine is in a self-running state.

2. An apparatus as claimed in claim 1 wherein said third means comprises:

(a) a pulse generator responsive to the rotation of the crankshaft of said engine for producing a pulse train signal;

(b) a frequency to voltage converter responsive to said pulse train signal for producing an analogue signal indicative of the rotational speed of said engine; and (c) a comparator responsive to said analogue signal for producing an output signal when the voltage of said analogue signal exceeds a predetermined value, the output signal of said comparator indicating that said engine is in a self-running state.

3. An apparatus as claimed in claim 1, wherein said third means comprises:

(a) a pulse generator responsive to the rotation of the crankshaft of said engine for producing a pulse train signal;

(b) a frequency to voltage converter responsive to said pulse train signal for producing an analogue signal indicative of the rotational speed of said engine;

(c) a differentiator responsive to said analogue signal;

(d) a first comparator responsive to the output signal of said differentiator for producing an output signal when the voltage of the differentiated signal exceeds a predetermined value;

(e) a second comparator responsive to said analogue signal for producing an output signal when the voltage of said analogue signal is below a predetermined value; and (f) a flip-flop responsive to the output signals of said first and second comparators for producing an output signal which indicates that said engine is in the self-running state. (FIG. 3)

4. An apparatus as claimed in claim 1, wherein said fourth means comprises: a logic circuit for producing first and second signals, said first signal being used to control cranking duration of said engine while said second signal is used to control fuel supply duration of the fuel supply mechanism of said engine.

5. An apparatus as claimed in claim 1, wherein said second means comprises first and second monostable multivibrators responsive to said first signal, said first monostable multivibrator producing a pulse signal the width of which is greater than that of a pulse signal produced by said second monostable multivibrator; and wherein said fourth means comprises first and second logic gate circuits, said first logic gate circuit being responsive to said first signal, the output pulse of said first monostable multivibrator and said third signal, said second logic circuit being responsive to the output pulse of said second monostable multivibrator and said third signal, said first and second logic gate circuits respectively producing first and second control signals by which cranking duration and fuel supply duration are respectively controlled.

6. An apparatus as claimed in claim 1, further comprising:

(a) means for producing an output signal indicative of the engine temperature;

(b) a plurality of comparators responsive to said signal indicative of the engine temperature, the threshold values of said comparators being stepwise arranged for providing a plurality of temperature ranges;

(c) a monostable multivibrator for producing a pulse signal in response to the leading edge of said first signal;

(d) a plurality of logic gate circuits respectively responsive to the output signals of said comparators for transmitting the output pulse signal of said monostable multivibrator, said second means comprising a plurality of monostable multivibrators respectively responsive to the output signals of said logic gate circuits.

7. An apparatus for controlling the starting function of an internal combustion engine, comprising:

(a) means responsive to turning the ignition key of said internal combustion engine for producing a first signal indicating that the ignition key is turned on;

(b) first and second timer circuits responsive to said first signal for producing second and third signals, each of said second and third signals being produced for a predetermined period of time, the duration of said second signal being longer than that of said third signal;

(c) means for detecting a self-running state of said engine;

(d) a first logic circuit for transmitting said first signal only when said second signal is present and when said engine is in other than said self-running state, the output signal of said first logic circuit being used to actuate the starter motor to perform cranking of said engine; and (e) a second logic circuit responsive to said third signal and the output signal of said self-running state detecting means, said second logic circuit delivering an output signal for a period of time defined by the duration of said third signal, said second logic circuit delivering an output signal when a self-running state of said engine is established.

8. An apparatus for controlling a starting motor for an internal combustion engine, comprising:

(a) means responsive to a command signal for initiating operation of the motor of said internal combustion engine for producing a first signal;

(b) first and second timer circuits responsive to said first signal for producing second and third signals, each of said second and third signals being produced for a predetermined period of time, the duration of said second signals being longer than that of said third signal;

(c) means for detecting a self-running state of said engine;

(d) a first logic circuit for transmitting said first signal only when said second signal is present and when said engine is in other than said self-running state, the output signal of said first logic circuit being used to actuate the starter motor to perform cranking of said engine and (e) a second logic circuit responsive to said third signal and the output signal of said self-running state detecting means, said second logic circuit delivering an output signal for a period of time defined by the duration of said third signal, said second logic circuit delivering an output signal when a self-running state of said engine is established.

9. An apparatus for controlling the starting function of an internal combustion engine, comprising:

(a) first means responsive to turning the ignition key of said engine for producing a first signal indicating that said ignition key is in the on state;

(b) second means responsive to said first signal for producing a second signal for a predetermined period of time;

(c) third means for producing a third signal indicating that said engine is in a self-running state; and (d) fourth means responsive to said second and third signals for terminating the starting function of said engine upon absence of said second signal or when said engine is in a self-running state;

wherein said third means comprises:

(a) a pulse generator responsive to the rotation of the crankshaft of said engine for producing a pulse train signal;

(b) a frequency to voltage converter responsive to said pulse train signal for producing an analogue signal indicative of the rotational speed of said engine;

(c) a differentiator responsive to said analogue signal;

(d) a first comparator responsive to the output signal of said differentiator for producing an output signal when the voltage of the differentiated signal exceeds a predetermined value;

(e) a second comparator responsive to said analogue signal for producing an output signal when the voltage of said analogue signal is below a predetermined value; and (f) a flip-flop responsive to the output signals of said first and second comparators for producing an output signal which indicates that said engine is in the self-running state.

10. An apparatus for controlling the starting function of an internal combustion engine, comprising:

(a) first means responsive to turning the ignition key of said engine for producing a first signal indicating that said ignition key is in the on state;

(b) second means responsive to said first signal for producing a second signal for a predetermined period of time;

(c) third means for producing a third signal indicating that said engine is in a self-running state; and (d) fourth means responsive to said second and third signals for terminating the starting function of said engine upon absence of said second signal or when said engine is in a self running state;

wherein said second means comprises first and second monostable multivibrators responsive to said first signal, said first monostable multivibrator producing a pulse signal the width of which is greater than that of a pulse signal produced by said second monostable multivibrator; and wherein said fourth means comprises first and second logic gate circuits, said first logic gate circuit being responsive to said first signal, the output pulse of said first monostable multivibrator and said third signal, said second logic circuit being responsive to the output pulse of said second monostable multivibrator and said third signal, said first and second logic gate circuits respectively producing first and second control signals by which cranking duration and fuel supply duration are respectively controlled.

11. An apparatus for deriving in energization signal for a starter motor of an internal combustion engine, comprising:

(a) first means responsive to a command signal for energization of the starter motor for producing a first signal;

(b) second means responsive to said first signal for producing a second signal for a predetermined period of time after derivation of a leading edge of the first signal;

(c) third means responsive to operation of said engine for producing a third signal indicating that said engine is in a self-running state; and (d) fourth means responsive to said second and third signals for deriving the energization signal only while the second signal is being produced and for preventing derivation of the energization signal while the third signal is being produced.

* * * * *